United States Patent [19]

Higgins

[11] Patent Number: 4,729,770

[45] Date of Patent: Mar. 8, 1988

[54] PROCESSES AND COMPOSITIONS FOR ABRASIVE BLAST CLEANING

[75] Inventor: George L. Higgins, Windsor, England

[73] Assignee: Pyrene Chemical Services Limited, Buckinghamshire, England

[21] Appl. No.: 34,830

[22] Filed: Apr. 6, 1987

[30] Foreign Application Priority Data

Apr. 11, 1986 [GB] United Kingdom ..... 8608797

[51] Int. Cl.[4] ..... B24D 3/00

[52] U.S. Cl. ..... 51/293; 51/319; 102/301; 134/7

[58] Field of Search ..... 51/293, 319; 102/301; 134/7

[56] References Cited

U.S. PATENT DOCUMENTS

| | | | |
|---|---|---|---|
| 3,313,067 | 4/1967 | Smith et al. | 51/298 |
| 3,765,923 | 10/1973 | Bender-Christensen | 51/308 |
| 4,125,969 | 11/1978 | Easton | 51/320 |
| 4,333,743 | 6/1982 | Nojima | 51/298 |
| 4,519,811 | 5/1985 | Lalancette et al. | 51/309 |
| 4,666,465 | 5/1987 | Matsumoto et al. | 51/293 |

*Primary Examiner*—Paul Lieberman
*Assistant Examiner*—Willie J. Thompson
*Attorney, Agent, or Firm*—Arthur E. Kluegel

[57] ABSTRACT

An aqueous wet blasting composition and process for cleaning a ferrous surface which reduces the rusting of the surface due to aqueous contact by incorporating phosphate ions and an imine compound in the composition.

11 Claims, No Drawings

PROCESSES AND COMPOSITIONS FOR ABRASIVE BLAST CLEANING

BACKGROUND OF THE INVENTION

It is common to use abrasive blast cheaning, i.e., "shot-blasting", to clean and prepare large areas of ferrous articles, especially hot rolled steel, as a preparation for painting. It is becoming increasingly common, the health and safety and environmental reasons, to inject water into the air/abrasive stream, thus suppressing dust and fumes which are otherwise dangerous and a nuisance to the operator and the surroundings. The resultant process may be termed "wet blasting". An advantage of wet blasting is that it appears to remove soluble corrosive salts that are not removed by dry blasting. However wet blasting suffers from a major disadvantage which is that the freshly blasted steel surface is very clean and reactive but is damp and so rusts freely. The resultant rust bloom on the surface is regarded as detrimental to the properties of subsequently applied paint coatings.

It is known to include an inhibitor in the injected water with the intention of preventing this rusting.

The inhibitors that have been proposed commercially are sodium nitrite and a polyphosphate such as material sold under the trade name Nalfloc 918. These are both very sensitive to concentration problems. Thus sodium nitrite can reduce the rate of rust formation if applied at the right concentration but if it is applied at a concentration that is too low or too high it can accelerate rust formation. Polyphosphate permits rust formation if it is applied at a concentration that is too low and if it is applied at a concentration that is too high, or if the wash water accumulates and dries on the surface, the adhesion of subsequently applied paint is unsatisfactory. The films are water soluble and are liable to be rinsed off the surface.

It is well known to form phosphate coatings on ferrous surfaces by application to the surface of an acidic phosphate solution optionally containing heavy metal ions. In order to obtain a protective coating in a shorter time period, it is necessary to include nitrate or other accelerator system. However such solutions are not satisfactory for inclusion in the blast water during wet blasting as either they do not prevent rusting or they form a coating which does not provide satisfactory adhesion of subsequently applied paint.

It would be desirable to be able to prevent rusting during wet blasting and to promote good adhesion of subsequently applied paint, and in particular it would be desirable to provide such a system wherein satisfactory results can be achieved over a range of concentrations and irrespective of whether or not the coated surface is rinsed with water after the treatment.

SUMMARY OF THE INVENTION

In the invention an iron surface is cleaned by wet blasting and rusting of the cleaned surface is prevented or reduced by contacting the surface during blasting with an aqeuous solution containing phosphate ions and, as an inhibitor, an imine compound.

It is normally necessary to activate phosphate solutions so as to improve their reactivity with the coating but in the invention we inhibit rather than increase the reactivity.

The solution should therefore be free of components that will accelerate the activity of the solution and the solution is generally also substantially free of metal or ammonium or amine cations that could enter into the coating.

The solution is therefore best provided by dissolving in water either an imine phosphate (often in combination with free phosphoric acid) or free phosphoric acid and a water soluble imine compound, generally an imine carbonate.

DETAILED DESCRIPTION OF THE INVENTION

The imine compound contains a group C=NH. Any such compound that is soluble in phosphoric acid may be used. Suitable imine compounds include amino guanidine, auramine, creatine, dicyandiamidine, guanidine, phthalimide, pyrrol, pyrrolidine, pyrroline, rosinduline and B-triphenylguanidine but the preferred imine compound is guanidine, especially because of its availability as a carbonate which readily dissolves in free phosphoric acid. Thus the preferred compositions of the invention are made by blending guanidinium carbonate ($[(NH_2)_2C{=}NH]_2H_2CO_3$) with phosphoric acid in water, generally deionized water.

The ratio by weight phosphoric acid (measured as 100%) to quanidinium carbonate is preferably from 3 to 0.3:1, most preferably 0.5 to 0.75:1. Equivalent amounts of other guanidine or other imine compounds can be used. The amounts are not very critical. If the amount of phosphoric acid is higher than the optimum most of it will still react satisfactorily with the iron surface and any that does not react will generally be rinsed from the surface during application, especially if the surface is given a post rinse. If the amount of guanidinium compound is above the optimum then the composition may not be a true solution, in that some of the guanidinium compound may remain out of solution. Provided the amount is not too high, this may be technically acceptable even though it is economically undesirable.

The concentration of quanidine (measured as guanidinium carbonate) is preferably in the range 0.2 to 4.5 g/l with best results being achieved at around 1.5 to 2.5 g/l. If the solution is too weak the rust inhibition is inadequate and if the solution is too strong it may have detrimental effects on the subsequently applied paint films.

It appears that the treatment according to the invention forms a chemically bonded coating containing iron, imine and phosphate.

The contact with the imine-phosphate solution is conducted throughout the wet blasting or merely at the end of the wet blasting, by using the solution as the water that is injected into the air/abrasive blast.

The contact of the treatment solution with the iron surface during wet blasting is generally for from 0.1 to 2 minutes. Contact is generally effected at temperatures below 50° C., generally 10 to 25° C. solution temperature.

The wet blasting may be conducted in conventional manner. Suitable abrasives include steel shot and grit, flint shot, mineral slag or any other acceptable abrasive medium for use on steel by wet-blasting methods. Pressure of the air/abrasive blast is generally in the range 3.5 to 10 kg/cm$^2$. The amount of water that is injected is generally in the range 0.5 to 5 liters per minute.

The following is an example.

Hot rolled steel is subjected to wet blasting by a stream of air at 7 kg/cm$^2$ in which is entrained mineral slag abrasive and a solution of 2 g/l guanidinium carbonate and 1.32 g/l phosphoric acid (100%) is injected into the stream during wet blasting.

After contacting the surface with the imine solution the surface is allowed to dry, optionally after rinsing with water. Conventional paint may then be applied over the surface. There is substantially no rusting of the surface before painting and the paint adheres well.

What is claimed is:

1. In a process for cleaning a ferrous surface by wet blasting using a stream of air, water and abrasive particles, the improvement comprising reducing the rusting of the cleaned surface by contacting the surface during blasting with an aqueous solution containing phosphate ions and, an imine compound.

2. A process according to claim 1 in which the imine compound is selected from the group consisting of amino guanidine, auramine, creatine, dicyandiamidine, guanidine, phthalimide, pyrrol, pyrrolidine, pyrroline, rosinduline and B-triphenylguanidine.

3. A process according to claim 1 in which the imine compound is guanidine.

4. A process according to claim 1 in which the imine compound is guanidine introduced as a salt selected from guanidine carbonate and guanidine phosphate.

5. A process according to claim 1 in which the phosphate ions are introduced as phosphoric acid.

6. A process according to claim 1 in which the said aqueous solution contains (guanidine present in an amount of 0.2 to 4.5 g/l measured as guanidine carbonate and the ratio of phosphate ions (measured as 100% phosphoric acid) to guanidine (measured as guanidine carbonate) is 0.3:1 to 3:1.

7. A process according to claim 1 in which the said aqueous solution includes guanidine and the amount of guanidine is 1.5 to 2.5 g/l measured as guanidine carbonate and the ratio of phosphate (measured as 100% phosphoric acid) to guanidine, measured as guanidine carbonate, is 0.5 to 0.75:1.

8. A process according to claim 1 in which the said aqueous solution is used as the water in the wet blast for the final 0.1 to 2 minutes at a temperature below 50° C.

9. An aqueous solution comprising 0.2 to 4.5 g/l guanidine (measured as guanidine carbonate) and phosphate ions present in a ratio of phosphate ions (measured as 100% phosphoric acid) to guanidine (measured as guanidine carbonate) of 0.3 to 3:1.

10. The solution of claim 9 which is substantially free of accelerators for phosphating solutions.

11. The solution of claim 10 which is substantially free of metal, ammonium and amine ions capable of entering into a coating on the surface.

* * * * *